US011435041B2

(12) United States Patent
Player

(10) Patent No.: US 11,435,041 B2
(45) Date of Patent: Sep. 6, 2022

(54) LIGHTING APPARATUS FOR A FLAGPOLE

(71) Applicant: Bear Strategic Pty Ltd, Woolooware (AU)

(72) Inventor: Scott Player, Woolooware (AU)

( * ) Notice: Subject to any disclaimer, the term of this patent is extended or adjusted under 35 U.S.C. 154(b) by 0 days.

(21) Appl. No.: 17/227,349

(22) Filed: Apr. 11, 2021

(65) Prior Publication Data

US 2022/0154899 A1 May 19, 2022

(51) Int. Cl.

| | |
|---|---|
| ***F21S 9/03*** | (2006.01) |
| ***E04H 12/32*** | (2006.01) |
| ***F21Y 115/10*** | (2016.01) |
| ***F21Y 105/18*** | (2016.01) |

(52) U.S. Cl.
CPC ..... *F21S 9/037* (2013.01); *E04H 12/32* (2013.01); *F21Y 2105/18* (2016.08); *F21Y 2115/10* (2016.08)

(58) Field of Classification Search
CPC ..... F21S 9/037; E04H 12/32; F21Y 2105/18; F21Y 2115/10
USPC ..... 362/555
See application file for complete search history.

(56) References Cited

U.S. PATENT DOCUMENTS

2019/0137056 A1* 5/2019 Sreshta ..... F21V 23/0435

* cited by examiner

*Primary Examiner* — Andrew J Coughlin
*Assistant Examiner* — Jessica M Apenteng
(74) *Attorney, Agent, or Firm* — Steven R. Fairchild

(57) ABSTRACT

The present invention relates to a lighting apparatus (100) for a flagpole for illuminating a flag hoisted on the flagpole. The lighting apparatus (100) comprises a star polygon shaped disc (102) having an upper surface (102-1) and a lower surface (102-2), the lower surface (102-2) comprising a plurality of panels (106). Each of the plurality of panels (106) is inclined at an angle with respect to an adjacent panel (106). The lighting apparatus (100) further comprises a plurality of solar panels (104) installed on the upper surface (102-1) of the disc (102), and a plurality of lighting units (108) arranged in each of the plurality of panels (106) of the lower surface (102-2) of the disc (102). The lighting apparatus (100) emits light rays in the form of a star pattern and illuminates a wide coverage of the flag.

4 Claims, 5 Drawing Sheets

LIGHTING APPARATUS FOR A FLAGPOLE

COPYRIGHT STATEMENT

A portion of the disclosure of this patent document contains material that is subject to copyright protection. The copyright owner has no objection to the facsimile reproduction by anyone of the patent document or the patent disclosure as it appears in the Patent and Trademark Office patent file or records, but otherwise reserves all copyright rights whatsoever.

CROSS REFERENCE TO RELATED APPLICATION

The present application claims priority to Australian Design Number 202016293, filed on Nov. 18, 2020, and registered on Jan. 14, 2021, entirely incorporated herein by reference.

TECHNICAL FIELD

The present invention relates to lighting devices for a flagpole, and more specifically to a lighting apparatus for illuminating a flag hoisted on the flagpole.

BACKGROUND OF THE INVENTION

A flagpole used for hoisting a flag typically consists of a pole, hardware for raising a flag (e.g., halyard and pulley) and a finial, or decorative ornament on top of the pole which may have means for lighting the flag, especially at night when there is no source of light to illuminate the flag. Such flags may be the flags of nations, flags that display logos, names or designs signifying businesses, organizations, sporting teams, or other formal or informal groups. Some flagpoles employ separate means for lighting the flag hoisted thereon.

Efforts have been made in the past to provide techniques for lighting flags at night, for example ground lights that emit beams of light in a direction toward the flag or a set of light emitting diodes (LEDs) installed in a portion of the pole or the finial to emit beams of light in a direction toward the flag. However, such techniques become costly over time. There are also lighting devices are that powered with solar power, but to date such lighting devices are ineffective at beaming the light to where it is needed. For example, such existing solar lights will send a beam of light directly down the flagpole and will illuminate a portion of the flag and in some instances almost none of the flag depending how the wind is blowing the flag.

Examples include U.S. Pat. No. 8,858,015 (Harshaw), which discloses a solar collection and illumination apparatus; U.S. Pat. No. 9,863,592 (Toner), which discloses a lighting unit; US Published Patent Appl. No. 2019/0360650 (Toner), which discloses a lighting unit; the "Solar Lamp" available at https://officialflagpole.com/products/solar-lamp-pre-sale-ships-september-8th (last visited Apr. 11, 2021); and, the "Best Flagpole Solar Light Top Mounted Commercial Grade 800 Lumen," sold at https://fortisvex-.com/best-flagpole-solar-light-top-mounted-commercial-grade-800-lumen/ (last visited Apr. 11, 2021).

What is needed is an improved lighting device that can be mounted on flagpole or virtually any post that is capable of illuminating the flag or post at all times, that is, when the flag is still and not moving and when it is being moved by the wind. The lighting device needs to be easy to manufacture, inexpensive, easy to install and have a long working life.

There is therefore a need to develop a lighting apparatus for a flagpole which is easy to manufacture, inexpensive, easy to install and has a long service life, and which is capable of addressing such deficiencies while illuminating a wider coverage of the flag.

SUMMARY OF THE INVENTION

An aspect of the present invention relates to a lighting apparatus for a flagpole capable of illuminating a flag hoisted thereon with a wide angle light output. The lighting apparatus includes a non-convex polygon shaped disc having an upper surface and a lower surface, and a plurality of solar panels installed on the upper surface of the disc. The lower surface of the disc includes a plurality of panels, each of the plurality of panels being inclined at an angle with respect to an adjacent panel. The lighting apparatus also includes a plurality of lighting units arranged in each of the plurality of panels of the lower surface of the disc.

According to an embodiment of the present invention, the non-convex polygon shaped disc is a star-polygon shaped disc.

According to an embodiment of the present invention, each of the panels of the lower surface of the disc is inclined at an angle from center of the lower surface of the disc to an edge of the disc.

According to an embodiment of the present invention, each of the panels of the lower surface of the disc is inclined towards the upper surface of the disc at an angle from center of the lower surface of the disc to an edge of the disc.

According to an embodiment of the present invention, the plurality of lighting units comprise light emitting diodes (LEDs).

According to an embodiment of the present invention, the plurality of lighting units are arranged in a triangular pattern in each of the plurality of panels of the lower surface of the disc.

According to an embodiment of the present invention, the plurality of lighting units in a panel of the lower surface of the disc are arranged in a different pattern than the plurality of lighting units arranged in an adjacent panel of the lower surface of the disc.

According to an embodiment of the present invention, the plurality of lighting units arranged in the plurality of panels of the lower surface of the disc emit light rays in the form of a star pattern.

According to an embodiment of the present invention, the plurality of lighting units arranged in the plurality of panels of the lower surface of the disc emit a wide angle light output for illuminating a flag hoisted on the flagpole.

An object of the present invention is to provide a lighting apparatus for a flagpole which is easy to manufacture, inexpensive, easy to install and has a long service life.

Another object of the present invention is to provide a lighting apparatus for a flagpole, capable of illuminating a wide coverage of a flag hoisted on the flagpole.

Another object of the present invention is to provide a lighting apparatus for a flagpole, capable of emitting light rays in the form of a star pattern.

Still another object of the present invention is to provide a lighting apparatus for a flagpole having a star polygon shaped disc, capable of accommodating large solar panels allowing large capacity batteries for longer battery life and longer light output.

Yet another object of the present invention is to provide a lighting apparatus for a flagpole, capable of being retrofitted to conventional flagpoles.

BRIEF DESCRIPTION OF THE DRAWINGS

The accompanying drawings are included to provide a further understanding of the present disclosure, and are incorporated in and constitute a part of this specification. The drawings illustrate exemplary embodiments of the present disclosure and, together with the description, serve to explain the principles of the present disclosure.

In the figures, similar components and/or features may have the same reference label. Further, various components of the same type may be distinguished by following the reference label with a second label that distinguishes among the similar components. If only the first reference label is used in the specification, the description is applicable to any one of the similar components having the same first reference label irrespective of the second reference label.

DETAILED DESCRIPTION OF THE PREFERRED EMBODIMENTS

For a more complete understanding of the present invention, the objects and advantages thereof, reference is now made to the ensuing descriptions.

As used in the description herein and throughout the claims that follow, the meaning of "a," "an," and "the" includes plural reference unless the context clearly dictates otherwise. Also, as used in the description herein, the meaning of "in" includes "in" and "on" unless the context clearly dictates otherwise.

If the specification states a component or feature "may", "can", "could", or "might" be included or have a characteristic, that particular component or feature is not required to be included or have the characteristic.

Exemplary embodiments will now be described more fully hereinafter with reference to the accompanying drawings, in which exemplary embodiments are shown. This disclosure may however, be embodied in many different forms and should not be construed as limited to the embodiments set forth herein. These embodiments are provided so that this disclosure will be thorough and complete and will fully convey the scope of the disclosure to those of ordinary skill in the art. Moreover, all statements herein reciting embodiments of the disclosure, as well as specific examples thereof, are intended to encompass both structural and functional equivalents thereof. Additionally, it is intended that such equivalents include both currently known equivalents as well as equivalents developed in the future (i.e., any elements developed that perform the same function, regardless of structure).

Various terms as used herein are shown below. To the extent a term used in a claim is not defined below, it should be given the broadest definition persons in the pertinent art have given that term as reflected in printed publications and issued patents at the time of filing.

In some embodiments, the numerical parameters set forth in the written description and attached claims are approximations that can vary depending upon the desired properties sought to be obtained by a particular embodiment. In some embodiments, the numerical parameters should be construed in light of the number of reported significant digits and by applying ordinary rounding techniques. Notwithstanding that the numerical ranges and parameters setting forth the broad scope of some embodiments of the invention are approximations, the numerical values set forth in the specific examples are reported as precisely as practicable. The numerical values presented in some embodiments of the invention may contain certain errors necessarily resulting from the standard deviation found in their respective testing measurements.

Figure 1B:
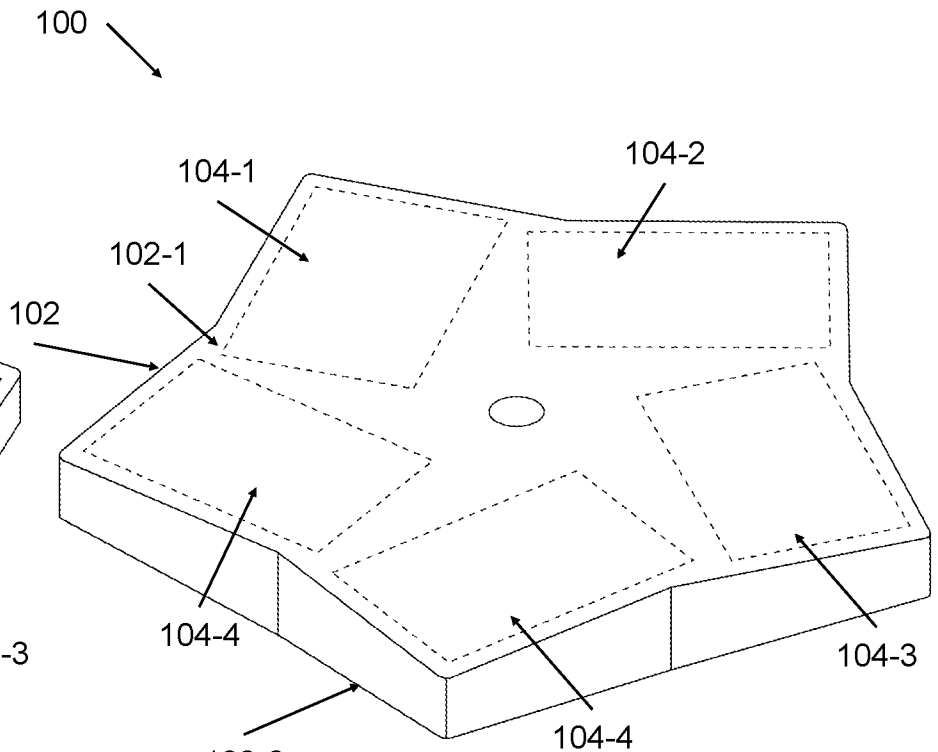
FIGS. 1A through 1C illustrate exemplary representations of an upper surface of a lighting apparatus for a flagpole in accordance with embodiments of the present invention.
Figure 1A:
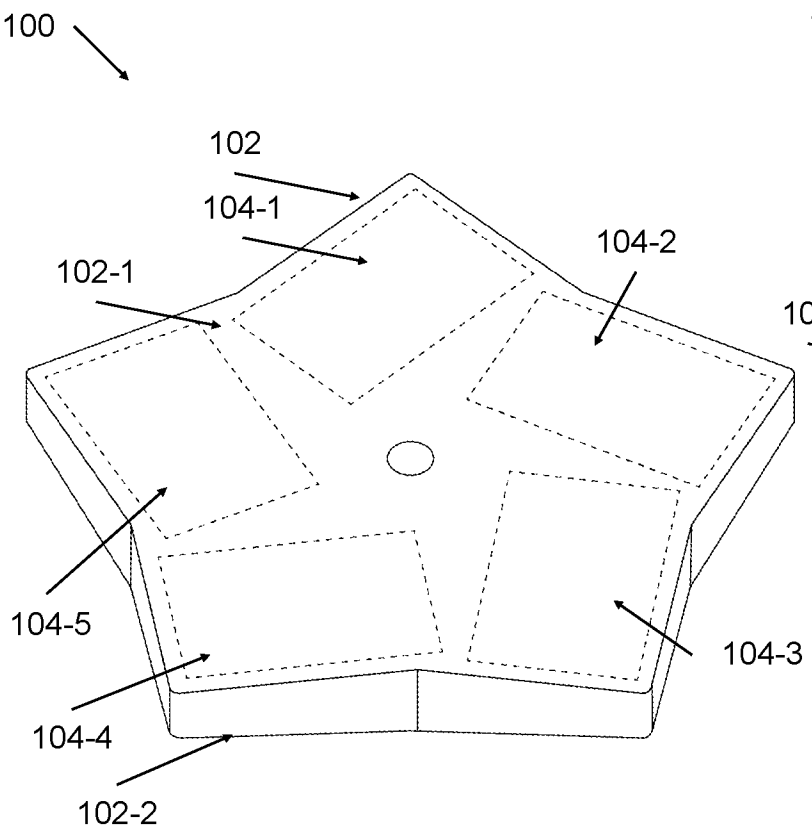
Figure 1C:
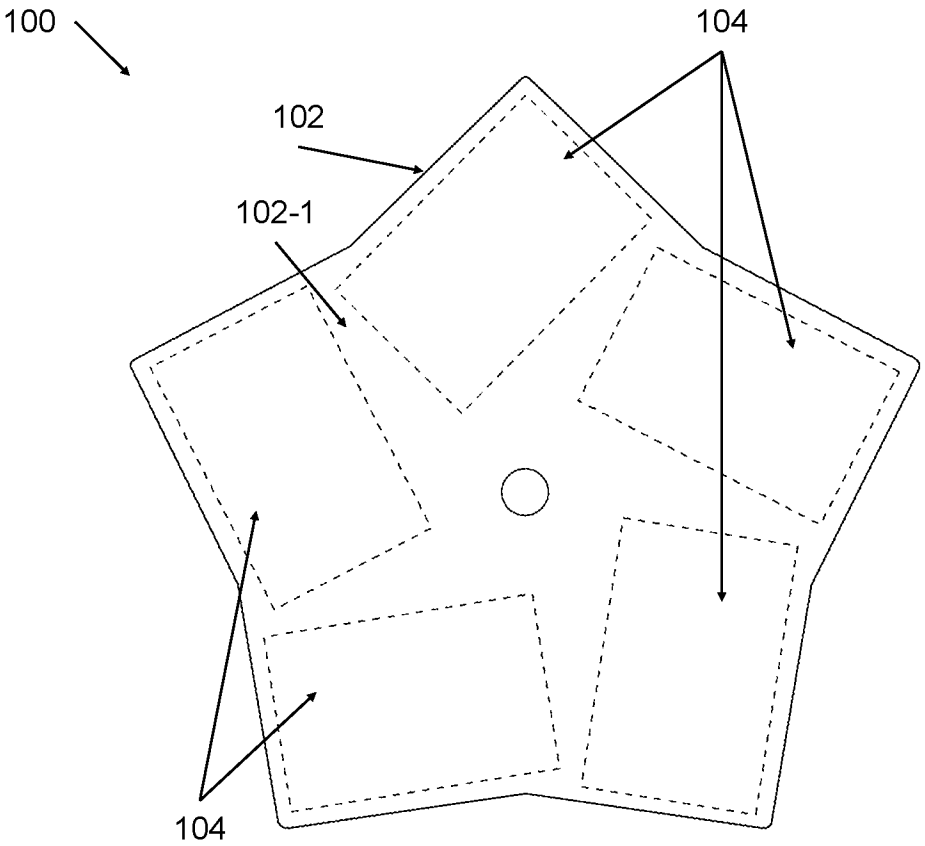
Figure 2B:
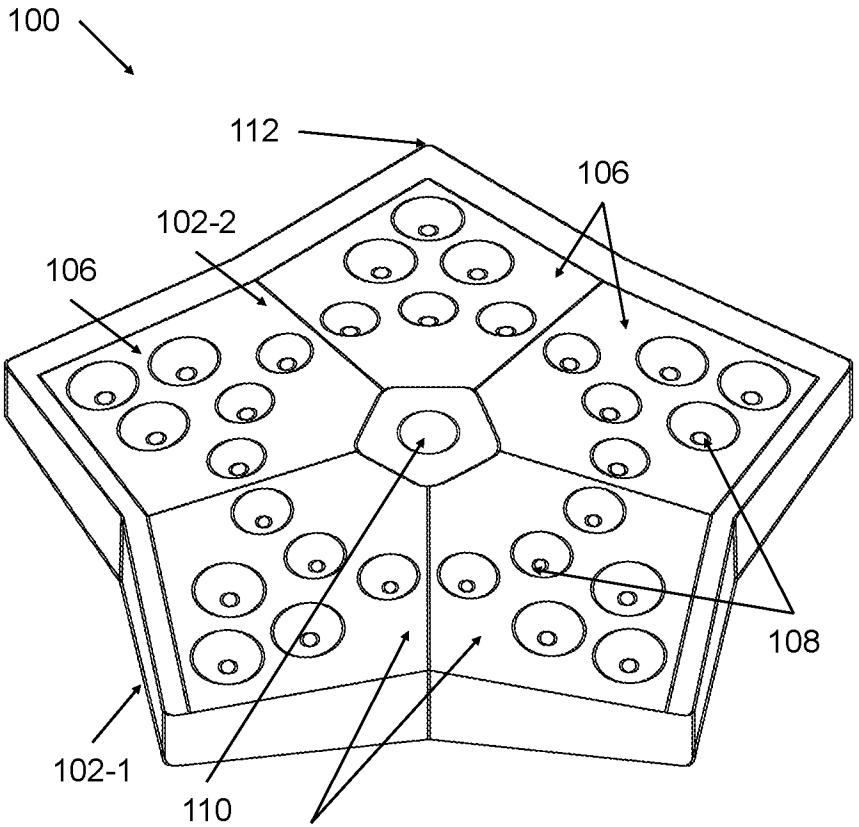
FIGS. 2A through 2D illustrate exemplary representations of a lower surface of the lighting apparatus in accordance with embodiments of the present invention.
Figure 2A:
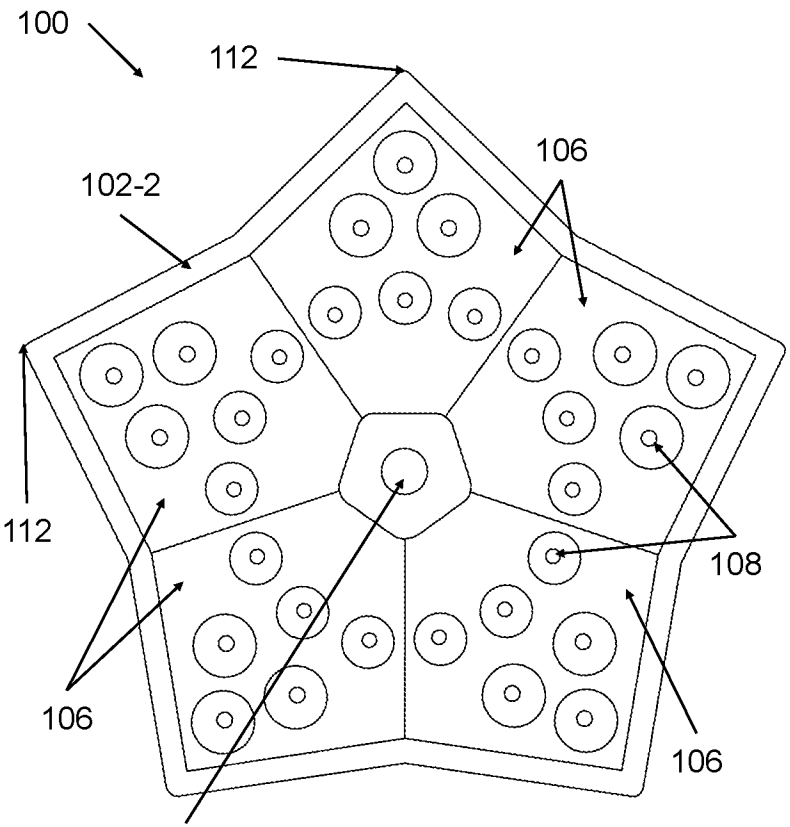
Figure 2D:
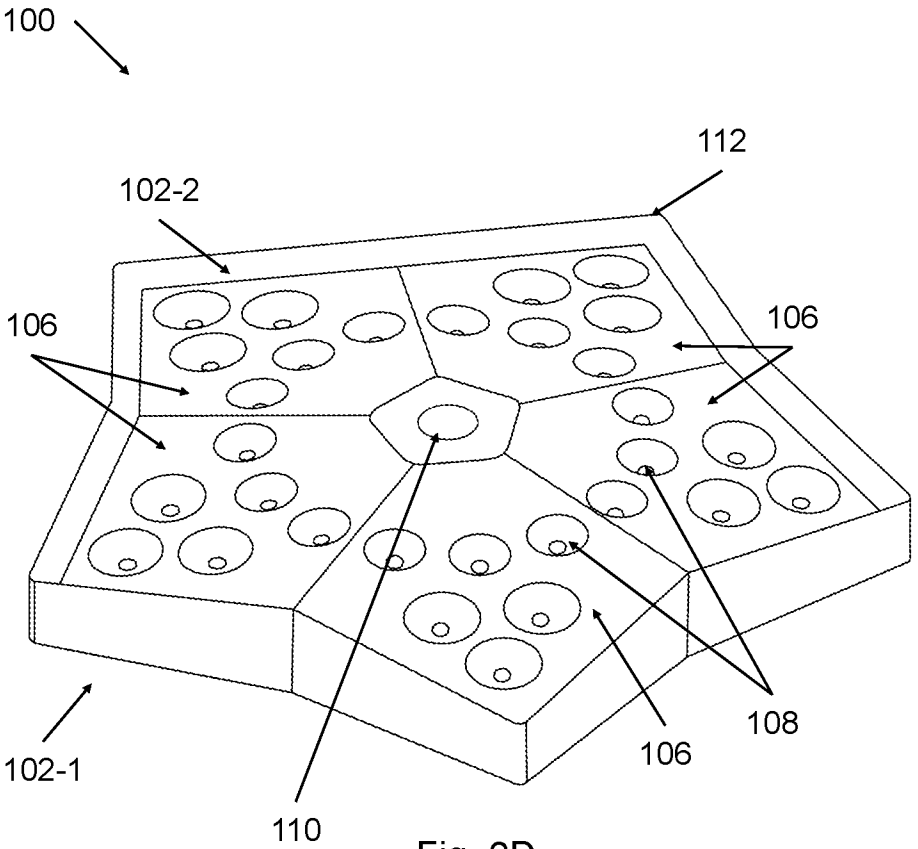
Figure 2C:
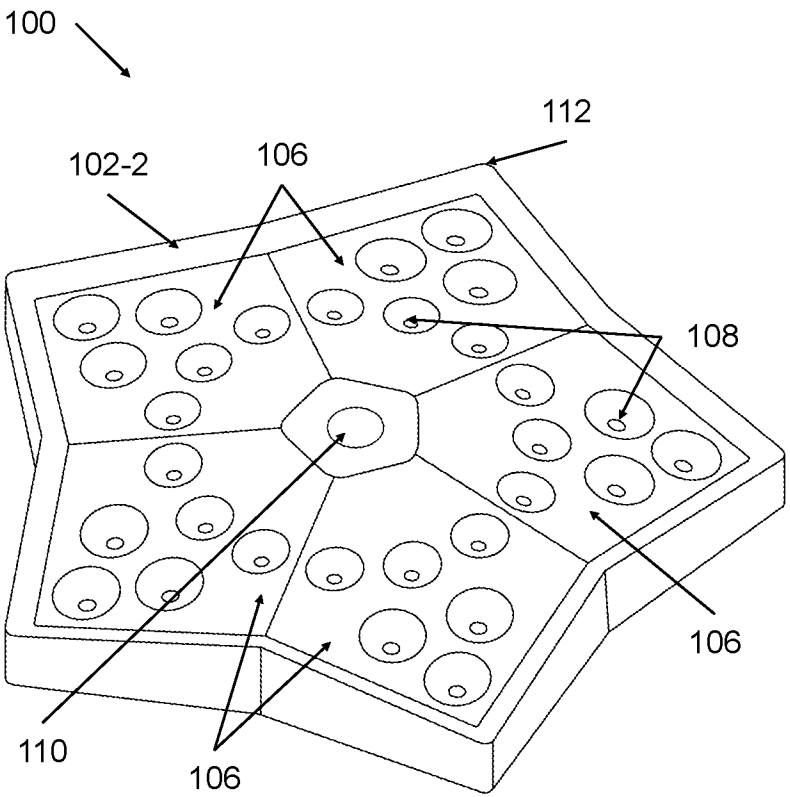

The present invention relates to a lighting apparatus for illuminating a flag hoisted on a flagpole with a wide angle distribution of light. The lighting apparatus is easy to manufacture and install and has a long service life. FIGS. 1A through 1C illustrate exemplary representations of the lighting apparatus (100). The lighting apparatus (100) includes a non-convex polygon shaped disc (102), in particular, a star polygon shaped disc, in the form of a concave decagon having ten edges and two sets of five vertices. The star polygon shaped disc (102) (also referred to as "disc (102)" hereinafter) has an upper surface (102-1) and a lower surface (102-2). As shown, the upper surface (102-1) of the disc (102) is equipped with a plurality of solar panels (104-1, 104-2, 104-2, . . . , 104-N) (also collectively referred to as "solar panels (104)" and individually referred to as "solar panel (104)" hereinafter). The solar panels (104) are installed on the upper surface (102-1) of the disc (102) in a pattern suitable for efficient utilization of solar energy received by the solar panels (104) in generation of electrical energy. The solar panels (104) may be installed over the upper surface (102-1) of the disc (102). According to another embodiment of the present invention, solar panels (104) may be embedded within the upper surface (102-1) of the disc (102).

According to an embodiment of the present invention, the plurality of solar panels (104) use light energy from the sun to generate electricity through photovoltaic effect. The solar panels (104) may use wafer-based crystalline silicon cells or thin-film cells. The solar panels (104) may include multiple cells connected electrically in series, one to another to a desired voltage, and then in parallel to increase amperage.

According to an embodiment of the present invention, the solar panels (104) may be arranged on the upper surface (102-1) of the star polygon shaped disc (102) in the pattern as shown in FIG. 1A.

Referring now to FIGS. 2A through 2D, where different representations of the lower surface (102-2) of the lighting apparatus (102) are shown. The lower surface (102-2) of the star polygon shaped disc (102) includes a plurality of panels (106-1, 106-2, 106-2, . . . , 106-N) (also collectively referred to as "faces (106)" and individually referred to as "face (106)" hereinafter). Each of the plurality of panels (106) is inclined at an angle with respect to an adjacent panel (106).

According to an embodiment of the present invention, each of the panels (106) may be inclined at an angle from center (110) of the lower surface (102-2) of the disc (102) to an edge (112) of the disc (102).

According to an embodiment of the present invention, the lighting apparatus (100) also includes a plurality of lighting units (108) arranged in each of the plurality of panels (106) of the lower surface (102-2) of the disc (102). According to an embodiment of the present invention, the lighting units (108) may be light emitting diodes (LEDs) operable to emit light when electrical current flows through it. The lighting units (108) may be connected with the solar panels (104) via an electronic circuitry to utilize solar energy received by the solar panels (104) in the form of electrical energy.

According to an embodiment of the present invention, the star polygon shaped disc (102) may accommodate the electronic circuitry which controls conversion of solar energy received by the solar panels (104) into electrical energy to enable the lighting units (108) to emit light rays. The electronic circuitry may also control switching of the lighting units (108) such that the lighting units (108) are switched ON when there is absence of a source of light near the flag hoisted on the flagpole, for instance, at night. Further, the electronic circuitry may switch OFF the lighting units (108) when there a source of light is detected near the flag hoisted on the flagpole. The electronic circuitry may be provided with sensors to detect presence of source of light near the flag hoisted on the flagpole.

According to an embodiment of the present invention, the star polygon shaped disc (102) may accommodate a battery bank having one or more battery cells to store electrical energy supplied to the lighting units (108) via the electronic circuitry. The battery cells are configured to store electrical energy converted by the solar panels (104) during daytime. Owing to large circumferential area of the star polygon shaped disc (102), large solar panels may be accommodated on the upper surface (102-1) of the disc (102) and large battery bank having large capacity and size may be accommodated in the disc (102) to ensure long battery life and light output of the lighting units (108). Additionally, the star polygon shaped disc (102) may also accommodate a controller connected to the battery bank capable of allowing fast charging of the battery cells of the battery bank.

According to an embodiment of the present invention, the lighting units (108) in each of the panels (104) of the lower surface (102-2) of the star polygon shaped disc (102) may be arranged in a triangular pattern. The lighting units (108) may be arranged in each of the panels (104) of the lower surface (102-2) of the disc (102) in such a way that a set of lighting units (108) in proximity of the center (110) of the lower surface (102-2) of the disc (102) form an inner ring emitting light rays and another set of lighting units (108) in proximity of edges of the disc (102) form an outer ring emitting light rays.

According to another embodiment of the present invention, the lighting units (108) in each of the panels (106) of the lower surface (102-2) of the star polygon shaped disc (102) may be arranged in a pattern different from pattern of the lighting units (108) in an adjacent panel (104).

Figure 3A:
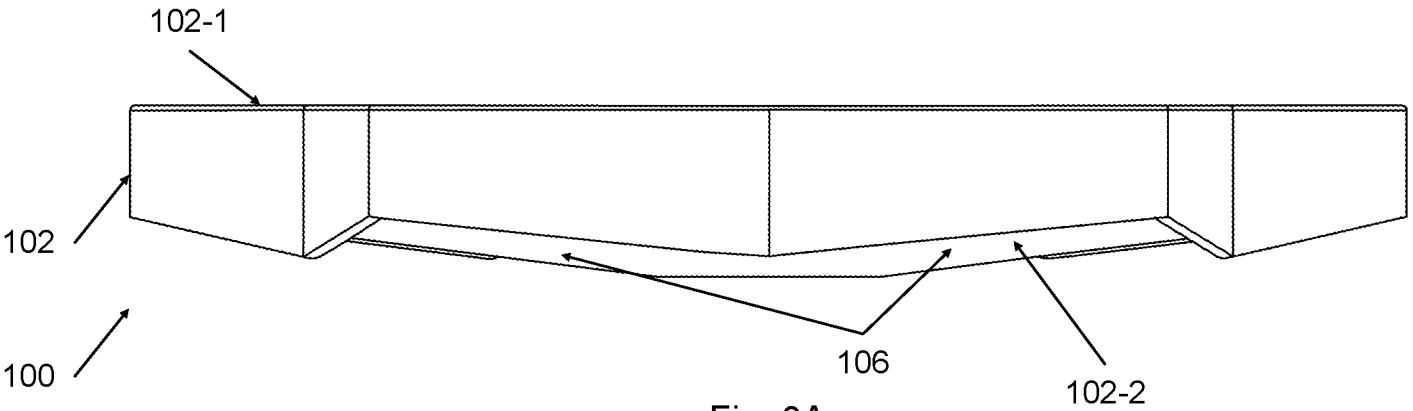
FIGS. 3A and 3B illustrate exemplary side view representations of the lighting apparatus in accordance with an embodiment of the present invention.
Figure 3B:
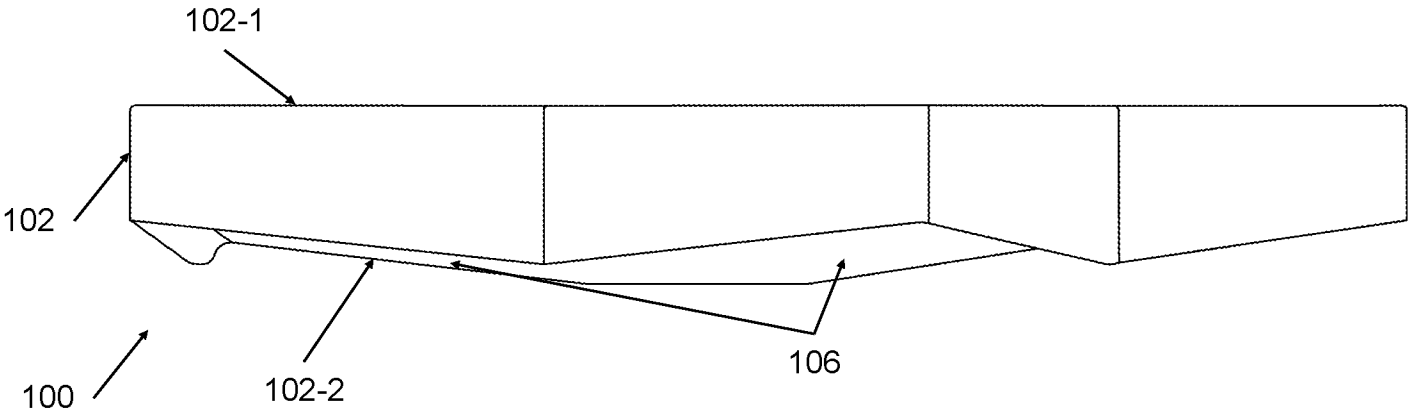

Referring now to FIGS. 3A and 3B, where side view representations of the lighting apparatus are shown. According to an embodiment of the present invention, each of the panels (106) of the lower surface (102-2) of the disc (102) may be inclined towards the upper surface (102-1) of the disc (102) at an angle from the center (110) of the lower surface (102-2) of the disc (102) to an edge (112) of the disc (102).

According to an embodiment of the present invention, the plurality of lighting units (108) arranged in the plurality of panels (106) of the lower surface (102-2) of the disc (102) emit light rays in the form of a star pattern extending radially outwards from the lower surface (102-2) of the disc (102).

According to an embodiment of the present invention, the plurality of lighting units (108) arranged in the plurality of panels (106) of the lower surface (102-2) of the disc (102) emit a wide angle light output for illuminating a flag hoisted on the flagpole.

According to an embodiment of the present invention, since each of the panels (104) of the disc (102) is angled differently with respect to an adjacent panel (104), the lighting apparatus (100) is capable of wide distribution of light for illuminating wide coverage of the flag hoisted on the flagpole. According to an embodiment of the present invention, each of the lighting units (108) may emit light rays with an illumination angle ranging from 100° to 130° to ensure wide distribution of light.

Thus, the present invention relates to a lighting apparatus for a flagpole capable of illuminating a flag hoisted thereon with a wide angle light output. The lighting apparatus includes a non-convex polygon shaped disc having an upper surface and a lower surface, and a plurality of solar panels installed on the upper surface of the disc. The lower surface of the disc includes a plurality of panels, each of the plurality of panels being inclined at an angle with respect to an adjacent panel. The lighting apparatus also includes a plurality of lighting units arranged in each of the plurality of panels of the lower surface of the disc. The lighting apparatus emits light rays in the form of a star pattern.

While embodiments of the present disclosure have been illustrated and described, it will be clear that the disclosure is not limited to these embodiments only. Numerous modifications, changes, variations, substitutions, and equivalents will be apparent to those skilled in the art, without departing from the spirit and scope of the disclosure, as described in the claims.

ADVANTAGES OF THE PRESENT INVENTION

The present invention provides a lighting apparatus for a flagpole which is easy to manufacture, inexpensive, easy to install and has a long service life.

The present invention provides a lighting apparatus for a flagpole, capable of illuminating a wide coverage of a flag hoisted on the flagpole.

The present invention provides a lighting apparatus for a flagpole, capable of emitting light rays in the form of a star pattern.

The present invention provides a lighting apparatus for a flagpole having a star polygon shaped disc, capable of accommodating large solar panels allowing large capacity batteries for longer battery life and longer light output.

The present invention provides a lighting apparatus for a flagpole, capable of being retrofitted to conventional flagpoles.

As will be appreciated, the foregoing objects and examples are exemplary and embodiments need not meet all or any of the foregoing objects, and need not include all or any of the exemplary features described herein. Additional aspects and embodiments within the scope of the claims will be devised by those having skill in the art based on the teachings set forth herein.

While the invention has been described in connection with what are considered to be exemplary embodiments, it is to be understood that the invention is not limited to the disclosed embodiments, but on the contrary, is intended to cover various modifications and equivalent arrangements included within the spirit and scope of the appended claims.

I claim:

1. A lighting apparatus (100) for a flagpole, comprising: a non-convex polygon shaped disc (102) having an upper surface (102-1) and a lower surface (102-2), the lower surface (102-2) comprising a plurality of panels (106), wherein each of the plurality of panels (106) is inclined at an angle with respect to an adjacent panel (106);

a plurality of solar panels (104-1, 104-2, 104-3, . . . , 104-N) installed on the upper surface (102-1) of the disc (102); and a plurality of lighting units (108) arranged in each of the plurality of panels (106) of the lower surface (102-2) of the disc (102), wherein each of the panels (106) of the lower surface (102-2) of the disc (102) is inclined at an angle from center (110) of the lower surface (102-2) of the disc (102) to an edge (112) of the disc (102), each of the panels (106) of the lower surface (102-2) of the disc (102) is inclined towards the upper surface (102-1) of the disc (102) at an angle from center of the lower surface (102-2) of the disc (102) to an edge (112) of the disc (102), the plurality of lighting units (108) are arranged in a triangular pattern in each of the plurality of panels (106) of the lower surface (102-2) of the disc (102), the plurality of lighting units (108) in a panel (106) of the lower surface (102-2) of the disc (102) are arranged in a different pattern than the plurality of lighting units (108) arranged in an adjacent panel (106) of the lower surface (102-2) of the disc (102), and the plurality of lighting units (108) arranged in the plurality of panels (106) emit light rays in a star pattern extending radially outwards from the lower surface (102-2) of the disc (102) so as to illuminate a focused region pertaining to a flag hoisted on the flagpole at a particular distance from the lower surface (102-2) of the disc (102).

2. The lighting apparatus (100) as claimed in claim 1, wherein the non-convex polygon shaped disc (102) is a star-polygon shaped disc.

3. The lighting apparatus (100) as claimed in claim 1, wherein the plurality of lighting units (108) comprise light emitting diodes (LEDs).

4. The lighting apparatus (100) as claimed in claim 1, wherein the plurality of lighting units (108) arranged in the plurality of panels (106) of the lower surface (102-2) of the disc (102) emit a wide angle light output for illuminating a flag hoisted on the flagpole.

* * * * *